US006783374B2

(12) United States Patent
Uratani et al.

(10) Patent No.: US 6,783,374 B2
(45) Date of Patent: Aug. 31, 2004

(54) ELECTRONIC COMPONENT, COAXIAL CONNECTOR, AND COMMUNICATION DEVICE

(75) Inventors: Chikara Uratani, Kanazawa (JP); Yuichi Maruyama, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/745,120

(22) Filed: Dec. 21, 2000

(65) Prior Publication Data

US 2001/0034145 A1 Oct. 25, 2001

(30) Foreign Application Priority Data

Dec. 21, 1999 (JP) ..... 11-363505

(51) Int. Cl.[7] ..... H01R 12/00
(52) U.S. Cl. ..... 439/83; 439/188
(58) Field of Search ..... 439/83, 630, 188, 439/876, 63

(56) References Cited

U.S. PATENT DOCUMENTS 6,068,499 A * 5/2000 Kuriyama et al. ..... 439/188
6,081,996 A * 7/2000 Kruppa et al. ..... 29/840

FOREIGN PATENT DOCUMENTS

| | | |
|---|---|---|
| CN | 1223489 A | 7/1999 |
| EP | 0 765 010 A2 | 3/1997 |
| EP | 0 929 128 A1 | 7/1999 |
| JP | 1-137072 | 9/1989 |
| JP | 4-78767 | 7/1992 |
| JP | 5-50671 | 7/1993 |
| JP | 7-36370 | 7/1995 |
| JP | 10-003968 | 1/1998 |
| JP | 11-86986 | 3/1999 |
| JP | 11-265761 | 9/1999 |
| JP | 11-307188 | 11/1999 |
| KR | 1999-029171 | 4/1999 |

* cited by examiner

*Primary Examiner*—Alex Gilman
(74) *Attorney, Agent, or Firm*—Keating & Bennett, LLP

(57) ABSTRACT

An electronic component, a coaxial connector, and a communication device each have a structure wherein flux does not intrude into the components thereof during mounting. The coaxial connector includes a synthetic resin case divided into a lower-side insulative case and an upper-side insulative case, and a fixed terminal, a movable terminal, and an external terminal each being made of metal. The lower-side insulative case has two notches provided therein. One of the notches receives the lead potion of the fixed terminal, and the other of the notches receives the lead potion of the movable terminal. These notches are configured such that clearances are provided to prevent capillary effect from occurring between the lead portions of the respective two terminals and the lower-side insulative case.

20 Claims, 5 Drawing Sheets

ELECTRONIC COMPONENT, COAXIAL CONNECTOR, AND COMMUNICATION DEVICE

BACKGROUND OF THE INVENTION

1. Field of the Invention

The present invention relates to an electronic component, a coaxial connector, and a communication device.

2. Description of the Related Art

Mobile communication devices such as portable telephones use surface-mounting type coaxial connectors capable of switching signal paths. This type of coaxial connector is typically obtained by integrally molding a resin case, a fixed terminal, and a movable terminal having spring characteristics, by insert-molding.

In some cases, however, when a conventional surface-mounting type coaxial connector is mounted on a printed circuit board via reflow soldering, flux contained in cream solder intrudes into the resin case through small gaps between the resin case and the terminals. This causes a problem that the flux adheres to a portion where the fixed terminal and the movable terminal are in contact with each other, and this causes a contact failure.

Furthermore, even if this coaxial connector is not formed by integrally molding the resin case, the fixed terminal, and the movable terminal, contact failure occurs when a gap exists which allows for the capillary effect between the resin case and the terminals.

SUMMARY OF THE INVENTION

To overcome the above-described problems with the prior art, preferred embodiments of the present invention provide an electronic component, a coaxial connector, and a communication device having a unique construction arranged such that flux does not intrude into the components thereof during mounting.

Preferred embodiments of the present invention provide an electronic component including an insulative case, a plurality of surface-mounting terminals mounted on the insulative case, and a notch provided in the insulative case to receive the lead portion of at least one of the plurality of terminals. In this electronic component, a notch defines a clearance to prevent the occurrence of the capillary effect, the clearance being provided between the notch and the solder fillet portion of the at least one lead portion.

Another preferred embodiment of the present invention provides a coaxial connector including an insulative case having a hollow portion into which the central contact of a mating coaxial connector is inserted, a fixed terminal and a movable terminal for surface mounting, the fixed terminal and movable terminal being mounted in the hollow portion of the insulative case, a surface-mounting external terminal mounted on the outside of the insulative case, the surface-mounting external terminal being connected with the outer conductor of the mating coaxial connector, and notches provided in the insulative case, to receive lead portions of each of the fixed terminal and movable terminal, each of the notches having a clearance to prevent the occurrence of the capillary effect between each of the notches and the solder fillet portion of the lead portions.

Since a clearance is provided between the solder fillet portion of a terminal such as the fixed terminal or the movable terminal and the insulative case, no capillary effect of flux occurs between the solder fillet portion and the insulative case. When an electronic component such as a coaxial connector is mounted on a printed circuit board, therefore, flux does not intrude into the components through the gap between the terminal and the insulative case. Preferably, the notch in the insulative case has a clearance to prevent the occurrence of capillary effect, between the notch and the soldered portion of the lead portion, as well. This allows the notch to have clearances all around the lead portion, and further reduces the likelihood that the flux more will intrude into the components.

Even if a clearance is provided between the solder fillet portion and the insulative case, the flux will move beyond the solder fillet portion and will intrude into the insulative case through the gaps between the insulative case and the terminal, when an excess amount of solder is applied. Therefore, by providing a groove intersecting at least one terminal, on the divided surfaces of the insulative case, the groove provided on a divided surface secures a gap having which prevents capillary effect between the insulative case and the terminal, and thereby prevents the flux from flowing.

Moreover, by configuring the groove to have a substantially V-shaped cross-section, the removal of the insulative case from a mold is facilitated, and molding failure is greatly reduced. Also, by configuring the groove to extend in a direction that is substantially perpendicular to the flowing direction of the flux, the intrusion of the flux is reliably prevented.

The communication device in accordance with various preferred embodiments of the present invention can achieve a high reliability by being equipped with the electronic component and the coaxial connector having the above-described features.

The features, characteristics, elements and advantages of the present invention will be clear from the following detailed description of preferred embodiments of the invention in conjunction with the accompanying drawings.

DETAILED DESCRIPTION OF PREFERRED EMBODIMENTS

Figure 1:
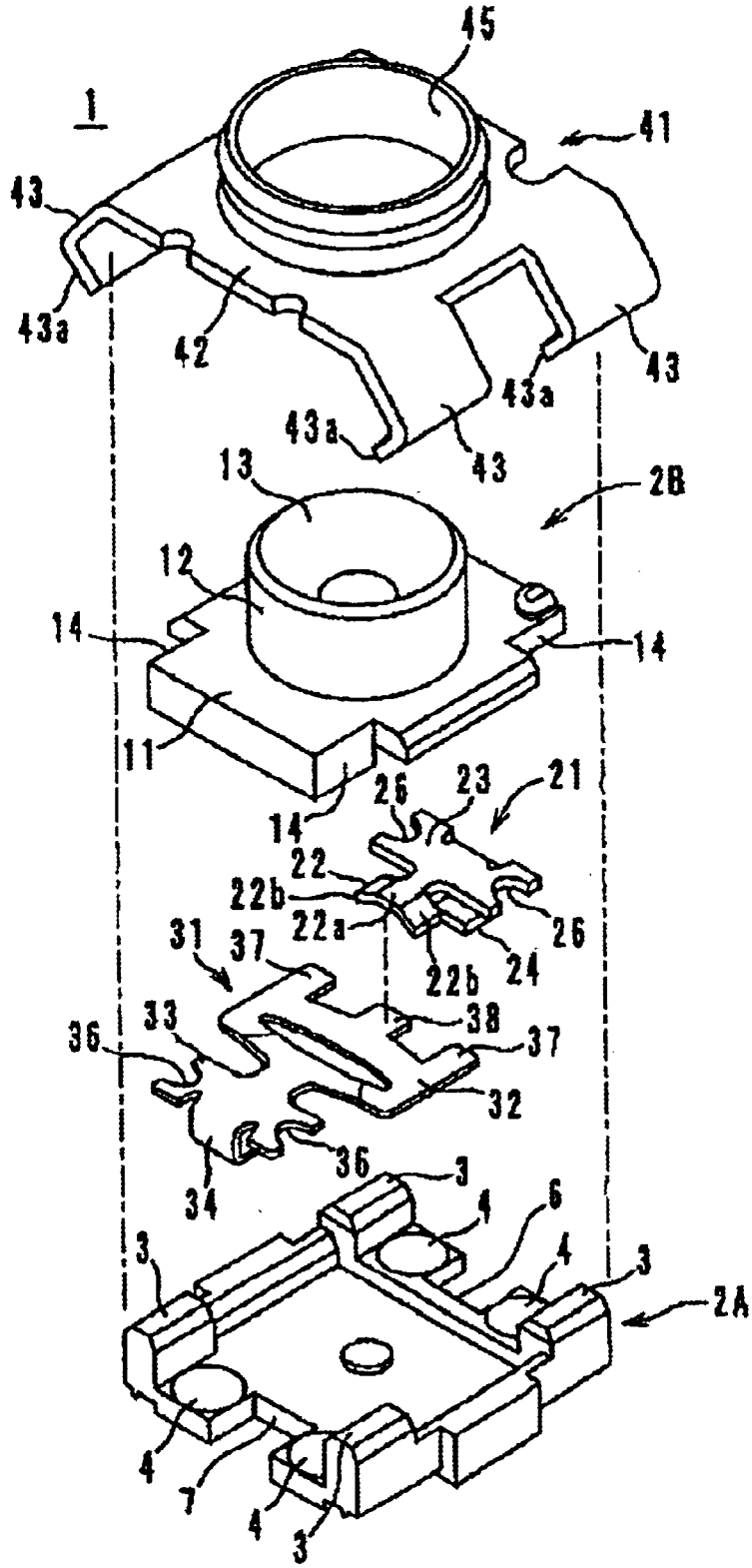
FIG. 1 is an exploded perspective view showing a preferred embodiment of a coaxial connector in accordance with the present invention.

FIG. 1 is an exploded perspective view showing a preferred embodiment of a coaxial connector in accordance with the present invention. This coaxial connector (coaxial receptacle) 1 includes an insulative case which is made of synthetic resin and which is divided into two portions, that is, a lower-side insulative case 2A and a upper-side insulative case 2B, a metallic fixed terminal 21, a metallic movable terminal 31, and an external terminal (outer conductor) 41.

The lower-side insulative case 2A preferably has a substantially rectangular shape, and includes guide protrusions 3 provided at the four corners of the top surface (a divided surface), for positioning of the upper-side insulative case 2B. In the vicinity of each guide protrusion 3, foot receiving portions 4 are provided for providing the feet 18 (see FIG. 2) of the upper-side insulative case 2B thereon. At the respective approximate central portions of the opposite two sides of the lower-side insulative case 2A, substantially rectangular notches 6 and 7 are provided, respectively. The lead portion 24 (described later) of a fixed terminal 21 is received in the notch 6, while the lead portion 34 (described later) of a movable terminal 31 is received in the notch 7.

The upper-side insulative case 2B includes a substantially rectangular cover portion 11 and a substantially cylindrical introduction portion 12 provided at the approximate central portion on the upper surface thereof. The substantially cylindrical introduction portion 12 is preferably configured in the form of cone at the upper portion, and includes a introduction hole 13 of which the cross section is preferably substantially circular. The introduction hole 13 passes through the upper-side insulative case 2B. The central contact of a mating coaxial connector is exposed in the introduction hole 13 through the substantially conical opening side. At the four corners of the cover portion 11, notches 14 are provided. The notches 14 are engaged with the guide protrusions 3 of the lower-side insulative case 2A, and thereby the upper-side insulative case 2B and the lower-side insulative case 2A are assembled with greatly improved positioning accuracy.

Figure 2:
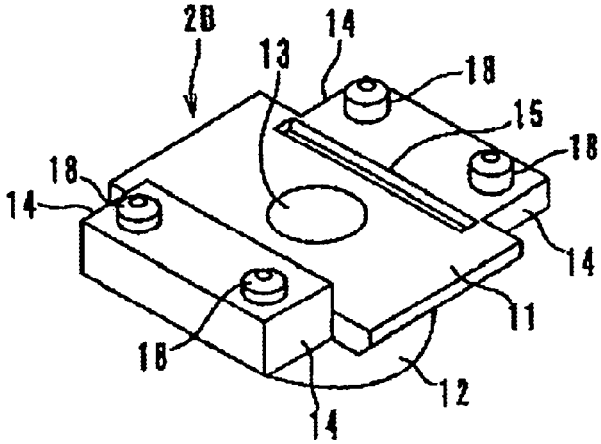
FIG. 2 is a perspective view illustrating the upper-side insulative case of the coaxial connector shown in FIG. 1, as seen from the bottom surface side.

As shown in FIG. 2, the feet 18 are provided on the bottom surface (a divided surface) of the upper-side insulative case 2B. A groove 15 having a substantially V-shaped cross-section is provided between the introduction hole 13 and the side from which the fixed terminal 21 is led out. The groove 15 extends in a direction that is substantially perpendicular to the direction in which the fixed terminal is led out. Configuring the groove 15 to have the substantially V-shaped cross-section facilitates the removal of the upper-side insulative case 2B from a mold, when producing the upper-side insulative case 2B by molding. This greatly reduces molding failure.

The fixed terminal 21 is formed by stamping out a flat metallic plate and then subjecting the stamped-out plate to a bending process. The fixed terminal 21 includes a contact portion 22 defining a contact point with the movable terminal 31, a fixation portion 23 pinched between the insulative case 2A and 2B, and a lead portion 24 bent into a L-shape. The contact portion 22 is formed by folding both sides at a predetermined angle, and has a horizontal surface 22*a* and tilting surfaces 22*b* on both sides of the horizontal surface 22*a*.

The fixation portion 23 includes substantially semicircular recesses 26 provided on both sides thereof. Each of the recesses 26 is engaged with the feet 18 of the upper-side insulative case 2B, and thereby the fixed terminal 21 is built into the upper-side insulative case 2B with greatly improved positioning accuracy. At this time, the fixed terminal 21 is built into the upper-side insulative case 2B such that the horizontal surface 22*a* of the contact portion 22 and the fixation portion 23 are closely adhered on the bottom surface of the upper-side insulative case 2B. However, a gap exists at the portion where the fixed terminal 21 intersects the groove 15.

Figure 3:
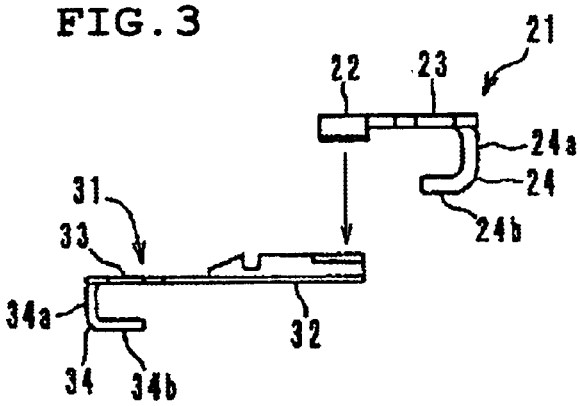
FIG. 3 is a front view showing the fixed terminal and the movable terminal of the coaxial connector shown in FIG. 1.

As shown in FIG. 3, the lead portion 24 includes a solder fillet portion 24*a* extending downward and substantially parallel with the side of the lower-side insulative case 2A, and a soldering portion 24*b* bent inward at a right angle to be substantially flush with the bottom surface of the lower-side insulative case 2A.

The movable terminal 31 is preferably formed by stamping out a metallic plate having spring characteristics into a predetermined shape, and then subjecting the stamped-out plate to a bending process. The movable terminal 31 includes a movable contact portion 32 which is configured to have a spring-movable function and which defines a contact point with the fixed terminal 21, a fixation portion 33 pinched between the insulative case 2A and 2B, and a lead portion 34 bent into a L-shape. The movable contact portion 32 is curved to arcuately bulge upward. The movable contact portion 32 includes a spring support portion 37 disposed at both ends thereof, and a spring contact portion 38 disposed at the approximate central portion thereof.

The fixation portion 33 includes substantially semicircular recesses 36 provided at both sides thereof. Each of the recesses 36 is engaged with the feet 18 of the upper-side insulative case 2B, and thereby the movable terminal 31 is built into the upper-side insulative case 2B with greatly improved positioning accuracy. At this time, the movable terminal 31 is built into the upper-side insulative case 2B such that the fixation portion 33 is closely adhered on the bottom surface of the upper-side insulative case 2B.

As shown in FIG. 3, a lead portion 34 includes a solder fillet portion 34*a* extending downward and substantially parallel with the side of the lower-side insulative case 2A, and a soldering portion 34*b* bent inward at a right angle so as to be substantially flush with the bottom surface of the lower-side insulative case 2A.

An external terminal 41 contacting the outer conductor of a mating coaxial connector is preferably formed by stamping out a metallic plate such as brass or phosphor bronze to provide spring characteristics, and subjecting the stamped-out plate to a bending or drawing process. A flat portion 42 at the approximate center of a plate-shaped body is provided on the top surface portion of the upper-side insulative case 2B. The flat portion 42 includes legs 43 provided at the four corners thereof. These legs 43 are folded along the side and the bottom surface of the assembly constituted of the terminals 21 and 31, and the insulative cases 2A and 2B. The assembly is very durable. The tip 43*a* of the leg portion 43 is disposed to be substantially flush with the bottom surface of the insulative case 2A, and provides a soldered portion.

Furthermore, at the approximate central portion of the flat portion 42, a through-cylinder portion 45 is arranged to be concentric with the substantially cylindrical introduction portion 12. The through-cylinder portion 45 is engaged with the outer conductor of the mating coaxial connector. The outer conductor 41 provides a ground, and the outer surface thereof is plated as required.

Figure 4:
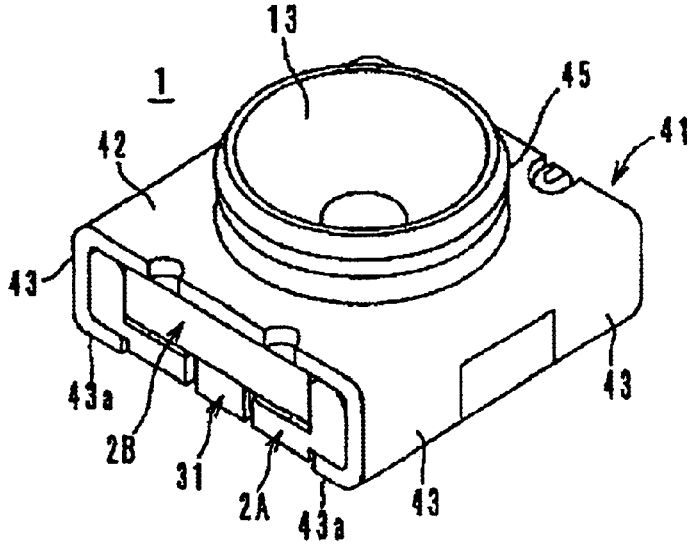
FIG. 4 is a perspective view showing the appearance of the coaxial connector shown in FIG. 1.
Figure 5:
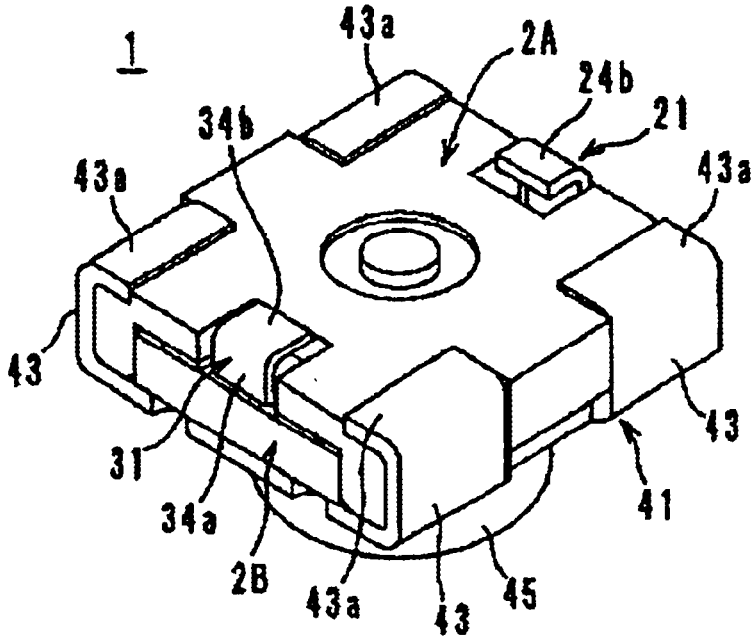
FIG. 5 is a perspective view showing the coaxial connector shown in FIG. 4, as seen from the bottom surface side.
Figure 6:
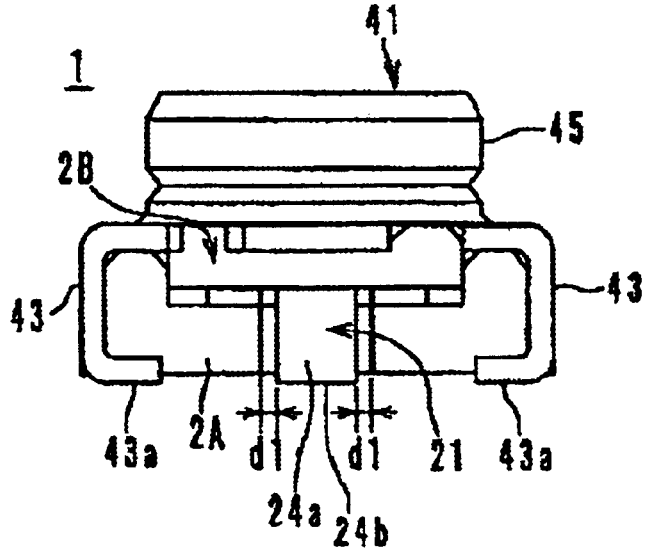
FIG. 6 is a side view showing the coaxial connector shown in FIG. 4, as seen from the fixed terminal side.
Figure 7:
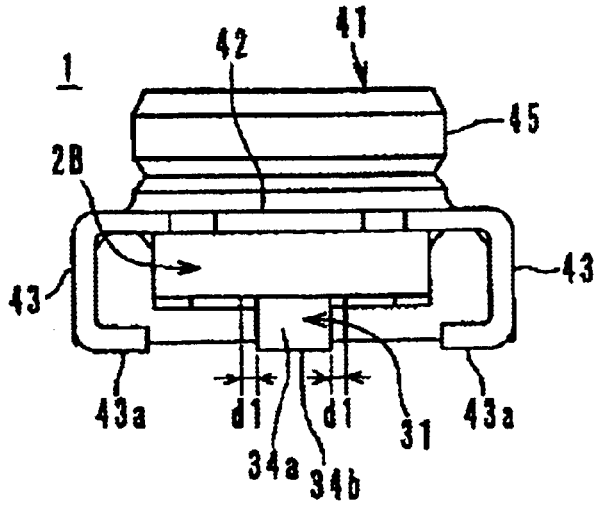
FIG. 7 is a side view showing the coaxial connector shown in FIG. 4, as seen from the movable terminal side.
Figure 8:
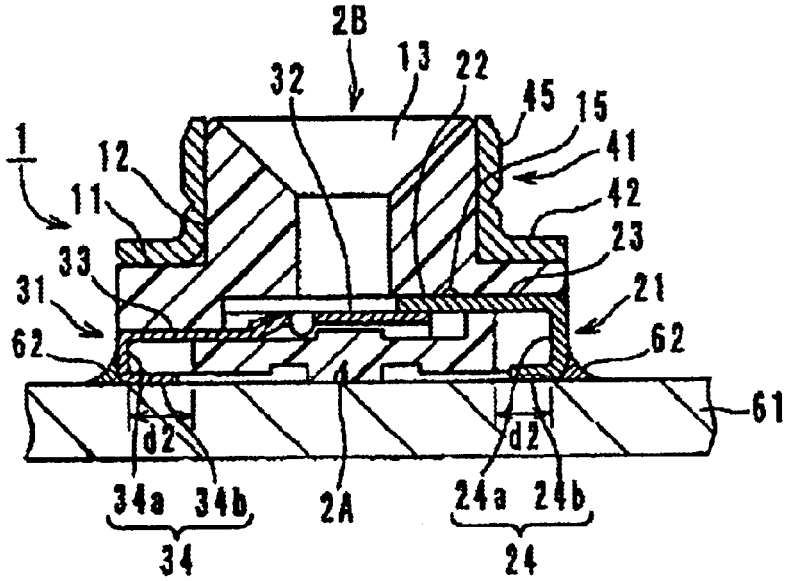
FIG. 8 is a sectional view showing the coaxial connector shown in FIG. 4.

FIG. 4 is a perspective view showing the assembled coaxial connector 1, as seen from the top surface side thereof, and FIG. 5 is a perspective view as seen from the bottom surface side. Also, FIG. 6 is a side view of the coaxial connector 1, as seen from the fixed terminal 21 side, FIG. 7 is a side view showing thereof, as seen from the movable terminal side 31, and FIG. 8 is a sectional view thereof. As illustrated in FIGS. 4 and 5, this coaxial connector 1 includes the soldered portions 24*b*, 34*b*, and 43*a* of the respective terminals 21, 31, and 41 provided to be substantially flush with the lower-side insulative case 2A, and thus enables surface-mounting. The outer terminal 41 includes the through-cylinder portion 45 provided therein, and thereby a stable and reliable connection with the mating coaxial connector is established. As illustrated in FIG. 8, in the inner space of the insulative case defined by the insulative case 2A and 2B, the fixed and movable terminals 21 and 31 are disposed with the fixed terminal 21 at the upper side.

As illustrated in FIG. 1, the lower-side insulative case 2A includes notches 6 and 7 provided therein. The notch 6 receives the lead portion 24 of the fixed terminal 21, and the notch 7 receives the lead portion 34 of the movable terminal 31. The notches 6 and 7 are configured such that clearances are set such that no capillary effect occurs between the lead portions 24 and 34 of the respective terminals 21 and 31, and the lower-side insulative case 2A. More specifically, as shown in FIGS. 6 through 8, the notches 6 and 7 are configured such that clearances d1 and d2 are set such that no capillary effect occurs between the fillet portions 24*a* and 34*a* of the respective terminals 21 and 31, and the lower-side insulative case 2A. Furthermore, the notches 6 and 7 are also configured such that clearances are set such that no capillary effect occurs between the soldered portions 24*b* and 34*b* and the lower-side insulative case 2A.

Hence, when the coaxial connector 1 is surface-mounted on a printed circuit board 61 by the reflow method, the soldered portions 24*b*, 34*b*, and 43*a* are disposed on the conductor pattern (not shown) on the printed circuit board 61, and solder fillets 62 are provided on the solder fillet portions 24*a* and 34*a*, no capillary effect of the flux contained in the cream solder occurs. The flux contained in the cream solder, therefore, does not intrude into the coaxial connector through the gaps between the terminals 21 and 31 and the insulative case 2A and 2B, respectively. Consequently, the flux does not adhere to the contact portion 22 of the fixed terminal 21 and the movable contact portion 32 of the movable terminal 31, which results in greatly improved contact reliability at terminal contact points.

Even if clearances d1 and d2 are provided between the solder fillet portions 24*a* and 34*a* and the lower-side insulative case 2A, the flux will intrude into the insulative case through the gaps between the insulative case 2A and 2B, and the terminals 21 and 31, if an excess amount of solder is applied. Therefore, by providing a groove 15 intersecting the fixed terminal 21 on a divided surface of the upper-side insulative case 2B, the groove 15 ensures a gap having such that no capillary effect occurs between the insulative case 2A and 2B and the fixed terminal 21, and thereby intrusion of the flux is prevented. Also, the flux intrudes along the surface of the fixed terminal 21, however since the groove 15 extends in the direction that is substantially perpendicular to the flowing direction of the flux, the intrusion of the flux is reliably prevented. The groove 25 is provided on the fixed terminal 21 side in this preferred embodiment because the distance from the lead portion 24 to the contact portion 22 is smaller than the length of the movable terminal 31, and thereby the effect of providing the groove 15 is significant.

Next, the operation of this coaxial connector 1 will be described with respect to FIGS. 8 and 9.

As illustrated in FIG. 8, when the mating coaxial connector is not mounted, the movable contact portion 32 bulges upward at the approximate central portion thereof. Hence, the movable terminal 31 makes contact with the fixed terminal 21 by the force due to the spring property of the movable contact portion 32, and thus the terminals 21 and 31 are electrically connected together.

Figure 9:
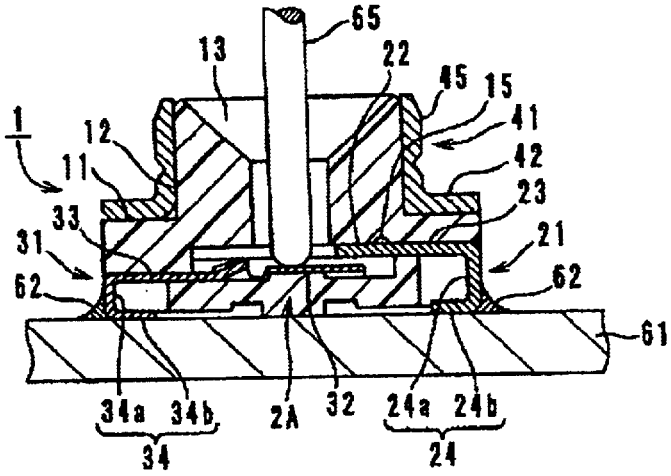
FIG. 9 is a sectional view showing a state in which a mating connector has been engaged with the coaxial connector shown in FIG. 4.

In contrast, as shown in FIG. 9, when the mating coaxial connector is mounted, the approximate central portion of the movable contact portion 32 is pushed downward by the central contact 65 of the mating coaxial connector inserted through the introduction hole 13 provided at upper side. As a result, the approximate central portion of the movable contact portion 32 is reversed and the approximate central portion thereof takes an arcuate shape with the approximate central portion thereof bulged downward. The spring contact portion 38 of the movable terminal 31 is detached from the contact portion 22 of the fixed terminal 21 and the electrical connection between the fixed terminal and the movable terminal is disconnected, while the approximate central contact 65 and the movable terminal 31 are electrically connected together. Simultaneously, the outer conductor (not shown) of the mating coaxial connector is engaged with the external terminal 41, and thereby the outer conductor is also electrically connected with the external terminal 41.

When the mating coaxial connector is dismounted from the coaxial connector 1, the central portion of the movable contact portion 32 returns, utilizing the spring characteristics thereof, to the state of bulging upward. As a result, the fixed terminal 21 and the movable terminal 31 are again electrically connected together, while the approximate central contact 65 and the movable terminal 31 are electrically disconnected.

Next, a communication device in accordance with a second preferred embodiment of the present invention will be described using a portable telephone as an example.

Figure 10:
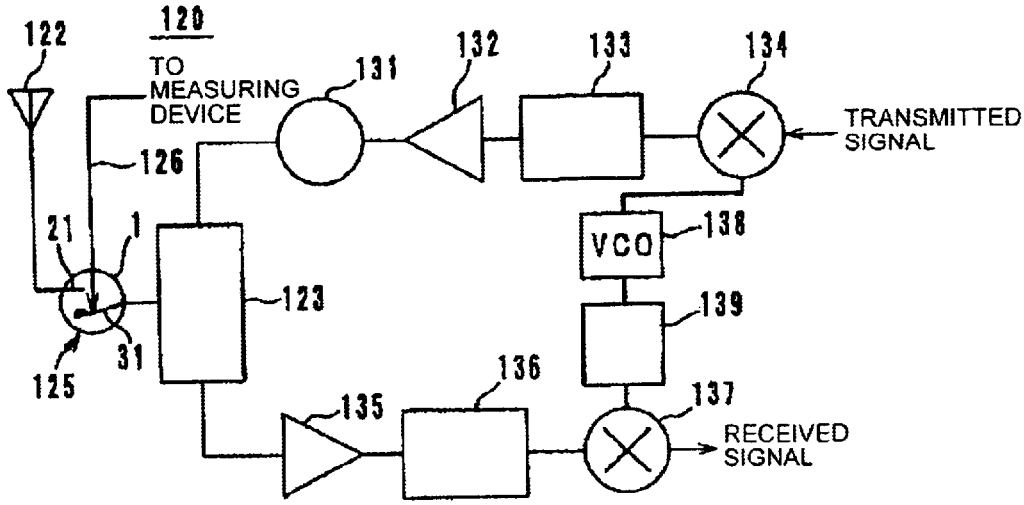
FIG. 10 is a block diagram showing a preferred embodiment of a communication device in accordance with the present invention.

FIG. 10 is a block diagram showing the electric circuit of the RF circuit portion of a portable telephone 120. In FIG. 10, reference numeral 122 is antenna element, 123 is a duplexer, 125 is a change-over switch, 131 is a transmission-side isolator, 132 is a transmission-side amplifier, 133 is a transmission-side interstage band-pass filter, 134 is a transmission-side mixer, 135 is a reception-side amplifier, 136 is a reception-side interstage band-pass filter, 137 is a reception-side mixer, 138 is a voltage control oscillator (VCO), and 139 is a local band-pass filter.

Herein, as a change-over switch 125, the above-described coaxial connector 1 in accordance with the first preferred embodiment is used. Hence, for example, when a set maker checks the electric characteristics of a RF circuit portion in the production process of the portable telephones 120, by engaging a measuring probe (a mating coaxial connector) 126 connected to a measuring device with the coaxial connector 1, the signal path from the RF circuit portion to the antenna element 122 is switched to the signal path from the RF circuit portion to the measuring device. Once the measuring probe 126 is disengaged from the coaxial connector 1, the signal path returns to the signal path from the RF circuit portion to the antenna element 122. Mounting this coaxial connector 1 produces a portable telephone 120 with greatly improved reliability.

The electronic component, a coaxial connector, and a communication device are not limited to the above-described preferred embodiments, but can be modified within the spirit and scope of the invention.

In particular, the present invention can be applied to an electronic component including a surface-mounting terminal which is led out from an insulative case. For example, apart from the coaxial connector in accordance with the first preferred embodiment, the present invention can also be applied to a piezoelectric component, isolator, circulator, IC components, etc.

Also, the groove provided to eliminate capillary effect, may be provided only on the fixed terminal side as in the above-described preferred embodiments, or maybe provided only on the movable terminal side. Alternatively, the grooves may be provided on both the fixed terminal side and the movable terminal side. In the above-described preferred embodiments, a description has been provided of a coaxial connector wherein the terminals and the insulative case are separately produced. However, a coaxial connector formed by integral molding, that is, by insert-molding the terminals into the insulative case maybe alternative used. In addition, with regard to the outer shape of the insulative case or the shape of the hollow portion, other shapes, such as a rectangle, a circle, or other suitable shapes can be selected in accordance with specification.

As is evident from the above-described description, in accordance with various preferred embodiments of the present invention, a clearance is provided between the solder fillet portion of the terminal such as the fixed terminal or the movable terminal, or the soldered portion, and the insulative case, and hence no capillarity of flux occurs between the solder fillet portion and the insulative case during mounting.

When an electronic component such as a coaxial connector is mounted on a printed circuit board, therefore, flux does not intrude into the components through the gaps between the terminals and the insulative case.

Even if a clearance is provided between the solder fillet portion and the insulative case, the flux will move beyond the solder fillet portion and will intrude into the insulative case through the gaps between the insulative case and the terminals if an excessive amount of solder is applied. Therefore, by providing a groove intersecting at least one terminal, on the divided surface of the insulative case, the groove provided on the divided surface produces a gap which prevents capillary effect between the insulative case and the terminal, and thereby prevents the intrusion of the flux. This produces an electronic component, such as a coaxial connector or a communication device, having a greatly improved reliability.

Moreover, by configuring the groove with a substantially V-shaped cross-section, removal of the insulative case from a mold is greatly facilitated, and molding failure is greatly reduced. Also, by configuring the groove to extend in the direction that is substantially perpendicular to the intrusion direction of the flux, the intrusion of the flux is reliably inhibited.

While the invention has been described in its preferred embodiments, obviously, numerous modifications and variations of the present invention are possible in light of the above teachings. It is therefore to be understood that within the scope of the appended claims, the invention may be practiced otherwise than as specifically described.

What is claimed is:

1. An electronic component comprising:

an insulative case including a lower case portion and an upper case portion;

a plurality of surface-mounting terminals mounted on said insulative case;

at least one notch formed by a central substantially rectangular cut through the entire thickness of said lower case portion to accommodate a substantially L-shaped lead portion of at least one of said plurality of surface-mounting terminals; and said at least one notch providing a clearance between said lower case portion and said substantially L-shaped lead portion of said at least one of said plurality of surface-mounting terminals such that said substantially L-shaped lead portion does not contact any part of the lower case portion so as to prevent the occurrence of capillary effect of solder applied to said electronic component.

2. A communication device comprising an electronic component as claimed in claim 1.

3. An electronic component as claimed in claim 1, wherein said substantially L-shaped lead portion of said at least one of said plurality of surface-mounting terminals includes a solder fillet portion.

4. An electronic component as claimed in claim 3, wherein said clearance is provided between the solder fillet portion and said insulative case.

5. An electronic component as claimed in claim 1, further comprising:

a plurality of terminals led out from a divided surface of said insulative case to the outside of said insulating case;

a groove intersecting at least one of said plurality of terminals, said groove being provided in said divided surface of said insulative case.

6. An electronic component as claimed in claim 5, wherein said groove has a substantially V-shaped cross-section, and said groove extends in the direction that is substantially perpendicular to a flowing direction of flux.

7. An electronic component as claimed in claim 1, further comprising a fixed terminal and a movable terminal each having substantially L-shaped lead portions.

8. An electronic component according to claim 7, wherein said at least one notch includes a first notch and a second notch.

9. An electronic component according to claim 8, wherein said first notch receives said substantially L-shaped lead portion of said fixed terminal.

10. An electronic component according to claim 8, wherein said second notch receives said substantially L-shaped lead portion of said movable terminal.

11. An electronic component according to claim 7, wherein the movable terminal includes a movable contact portion having a spring property which bulges upward at an approximate central portion thereof, said movable terminal contacts said fixed terminal by the force caused by the spring property of the movable contact portion to electrically connect said movable terminal to said fixed terminal.

12. An electronic component according to claim 1, wherein said insulative case is made of resin.

13. A coaxial connector comprising:

an insulative case having a hollow portion into which a central contact of a mating coaxial connector is inserted and including a lower case portion and an upper case portion;

a fixed terminal and a movable terminal for surface mounting, said fixed terminal and movable terminal being mounted to the hollow portion of said insulative case;

a surface-mounting external terminal mounted onto the outside of said insulative case, said surface-mounting external terminal being electrically connected with an outer conductor of said mating coaxial connector; and notches formed by central substantially rectangular cuts through the entire thickness of said lower case portion to accommodate substantially L-shaped lead portions of each of said fixed terminal and movable terminal such that said substantially L-shaped lead portions do not contact any part of the lower case portion so as to prevent the occurrence of capillary effect of solder applied to said coaxial connector.

14. A communication device comprising a coaxial connector as claimed in claim 13.

15. A coaxial connector as claimed in claim 13, wherein each of said notches includes a clearance between said substantially L-shaped lead portions of each of said fixed terminal and said movable terminal and said insulative case to prevent the occurrence of capillary effect.

16. A coaxial connector as claimed in claim 15, wherein each of said clearances being defined between a solder fillet portion of said substantially L-shaped lead portions and said insulative case.

17. A coaxial connector as claimed in claim 13, wherein the substantially L-shaped lead portions of each of said fixed and movable terminals are led out from the divided surfaces of the insulative case to the outside of the insulative case, and further comprising:

a groove intersecting at least one of said fixed and movable terminals, said groove being provided in a divided surface of said insulative case.

18. A coaxial connector as claimed in claim 17, wherein said groove has a substantially V-shaped cross-section, and said groove extends in a direction that is substantially perpendicular to a flowing direction of flux.

19. An electronic component according to claim 13, wherein the movable terminal includes a movable contact portion having a spring property which bulges upward at the approximate central portion thereof, said movable terminal contacts said fixed terminal by the force caused by the spring property of the movable contact portion to electrically connect said movable terminal to said fixed terminal.

20. An electronic component according to claim 13, wherein said insulative case is made of resin.

* * * * *